US008439557B2

(12) United States Patent
Vaucher et al.

(10) Patent No.: US 8,439,557 B2
(45) Date of Patent: May 14, 2013

(54) SINGLE PIECE WHEEL SET FOR A TIMEPIECE

(75) Inventors: Frédéric Vaucher, La Chaux-de-Fonds (CH); Pierre Cusin, Villars-Burquin (CH); Marco Verardo, Les Bois (CH); Jean-Philippe Thiebaud, Cudrefin (CH)

(73) Assignee: Omega S.A., Bienne (CH)

( * ) Notice: Subject to any disclaimer, the term of this patent is extended or adjusted under 35 U.S.C. 154(b) by 147 days.

(21) Appl. No.: 13/165,359

(22) Filed: Jun. 21, 2011

(65) Prior Publication Data

US 2011/0310709 A1 Dec. 22, 2011

(30) Foreign Application Priority Data

Jun. 22, 2010 (EP) ..... 10166896

(51) Int. Cl.
*G04B 15/00* (2006.01)

(52) U.S. Cl.
USPC ..... 368/131; 368/132

(58) Field of Classification Search ..... 368/127–133
See application file for complete search history.

(56) References Cited

U.S. PATENT DOCUMENTS

| | | | | |
|---|---|---|---|---|
| 20,252 | A * | 5/1858 | Carpenter | 368/130 |
| 200,533 | A * | 2/1878 | Hitchcock | 368/133 |
| 515,862 | A * | 3/1894 | Eisen | 368/130 |
| 3,949,547 | A * | 4/1976 | Schneiter | 368/127 |
| 6,082,001 | A | 7/2000 | Bettelini | |
| 2006/0055097 | A1 | 3/2006 | Conus et al. | |
| 2008/0008051 | A1 | 1/2008 | Marmy et al. | |
| 2010/0308010 | A1 | 12/2010 | Cusin et al. | |

FOREIGN PATENT DOCUMENTS

| | | | |
|---|---|---|---|
| EP | 1 045 297 | A1 | 10/2000 |
| EP | 1 655 642 | A2 | 5/2006 |
| EP | 1 850 193 | A1 | 10/2007 |
| EP | 1 932 804 | A2 | 6/2008 |
| EP | 2 228 692 | A1 | 9/2010 |
| EP | 2 261 171 | A1 | 12/2010 |
| WO | 2007/099068 | A1 | 9/2007 |

OTHER PUBLICATIONS

European Search Report issued in corresponding application 10166896, completed Jan. 12, 2011.

* cited by examiner

*Primary Examiner* — Sean Kayes
(74) *Attorney, Agent, or Firm* — Griffin & Szipl, P.C.

(57) ABSTRACT

The invention relates to a single piece coaxial escape wheel set (100, 100') including a first toothing (108, 108') formed at the periphery of a plate (103, 103') and a second toothing (113, 113'). According to the invention, the second toothing (113, 113') is formed in a single piece with the plate (103, 103') of the first toothing (108, 108') so as to reduce any problems of alignment of one in relation to the other and to decrease the overall mass of the wheel set (100, 100').

The invention concerns the field of timepieces.

11 Claims, 3 Drawing Sheets

SINGLE PIECE WHEEL SET FOR A TIMEPIECE

This application claims priority from European Patent Application No. 10166896.0 filed Jun. 22, 2010, the entire disclosure of which is incorporated herein by reference.

FIELD OF THE INVENTION

The invention relates to a single piece wheel set, for example a coaxial escape wheel set, and more specifically to a wheel set of this type made of micro-machinable or electroformable material.

BACKGROUND OF THE INVENTION

In a known manner, the escapement of a mechanical timepiece movement, whether it is coaxial or a Swiss lever escapement, includes an escape wheel wherein the regularly spaced teeth undergo the shock of pallet-stones which are generally made of ruby.

An example of a coaxial escape system is presented in EP Patent No. 1 045 297. A mechanism of this type, as illustrated in FIG. 11, includes a wheel set formed of first 1 and second 11 escape wheels. The second escape wheel 11, also called an impulse pinion, is mounted on the same arbour 3. The angular position of teeth 13 of the second escape wheel 11 is indexed on the angular position of the teeth 8 of the first escape wheel 1.

The first escape wheel 1 takes the form of a conventional Swiss lever escape wheel. The second escape wheel 11 also acts as escape pinion 15 by meshing with an intermediate wheel 17, which has the advantage of reducing the height of the mechanism.

The roller 19 of the balance (not shown) carries an impulse-pin 21 and an impulse pallet-stone 23. The impulse-pin 21 is for driving lever 25, in a to-and-fro motion, via the fork 27 thereof, whereas impulse pallet-stone 23 is for cooperating with the teeth 8 of the first escape wheel 1.

Lever 25 includes an impulse pallet-stone 24 which cooperates with the teeth 13 of the second escape wheel 11. Lever 25 also includes two other, respectively entry and exit locking pallets 26, 28 which cooperate with the teeth 8 of the first escape wheel 1.

The design of this coaxial escapement requires very high precision, particularly as regards the relative alignment of the first 1 and second 11 escape wheels, which makes it difficult to manufacture. Moreover, generally speaking, the gear trains of a two level timepiece like the usual wheel-pinion type always need to have perfect indexing between them.

SUMMARY OF THE INVENTION

It is an object of the present invention to overcome all of part of aforecited drawbacks by proposing a wheel set, such as for example a coaxial escape wheel set, wherein the problems of alignment are reduced and the inertia is decreased.

The invention therefore relates to a single piece wheel set including a first toothing formed at the periphery of a plate and a second toothing, wherein the second toothing is formed in a single piece with the plate of the first toothing so as to reduce any problems of alignment of one relative to the other and to decrease the overall mass of the wheel set and, in particular, a coaxial escape wheel set wherein the first toothing is arranged to cooperate with a pin and at least a first series of pallet-stones and a second toothing arranged to cooperate with a second series of pallet-stones.

The advantage of this wheel set is immediately clear, arising from the simplicity of design (single piece and less material) compared to two parts which are difficult to adjust in relation to each other at present.

In accordance with other advantageous features of the invention:

- each tooth of the second toothing is independent of the other teeth and projects relative to the plate of the first toothing;
- the plate is formed of a hub connected to the first toothing via at least one arm;
- each tooth of the second toothing is integral with said at least one arm of the plate;
- the second toothing includes as many teeth as the plate has arms;
- the plate includes an opening for cooperating with an arbour for rotatably mounting said coaxial escape wheel set;
- the opening includes securing means that deform elastically to grip the arbour without exerting any destructive stress on the plate;
- the opening includes securing means that deform plastically to grip the arbour without exerting any destructive stress on the plate;
- the wheel set may be made of metal or a metal alloy or be silicon-based.

Moreover, the invention relates to a coaxial escape system for a timepiece including a lever that cooperates with a single piece coaxial escape wheel set according to one of the preceding variants, wherein the first toothing of the wheel set is arranged to cooperate with a pin integral with a balance and intended to cooperate with a first series of pallet-stones of the lever, the second toothing is intended to cooperate with a second series of pallet-stones of the lever and arranged to form the escape pinion.

BRIEF DESCRIPTION OF THE DRAWINGS

Other features and advantages will appear clearly from the following description, given by way of non-limiting indication, with reference to the annexed drawings, in which.

DETAILED DESCRIPTION OF PREFERRED EMBODIMENTS

Advantageously according to the invention, any problems of alignment between the first and second wheels are reduced by manufacturing a wheel set 100, 100' that joins said wheels to each other to make a single piece. Consequently, only teeth 113, 113' of one of the wheels are still necessary, which means that most of the plate of one of the two wheels is no longer needed, thereby also decreasing the mass of the escape wheel set 100, 100' and, incidentally, the inertia thereof. For greater simplicity, the following explanation is given with reference to a coaxial escape wheel. It is nonetheless clear that the invention is applicable to any type of wheel set with at least two levels.

Figure 9:
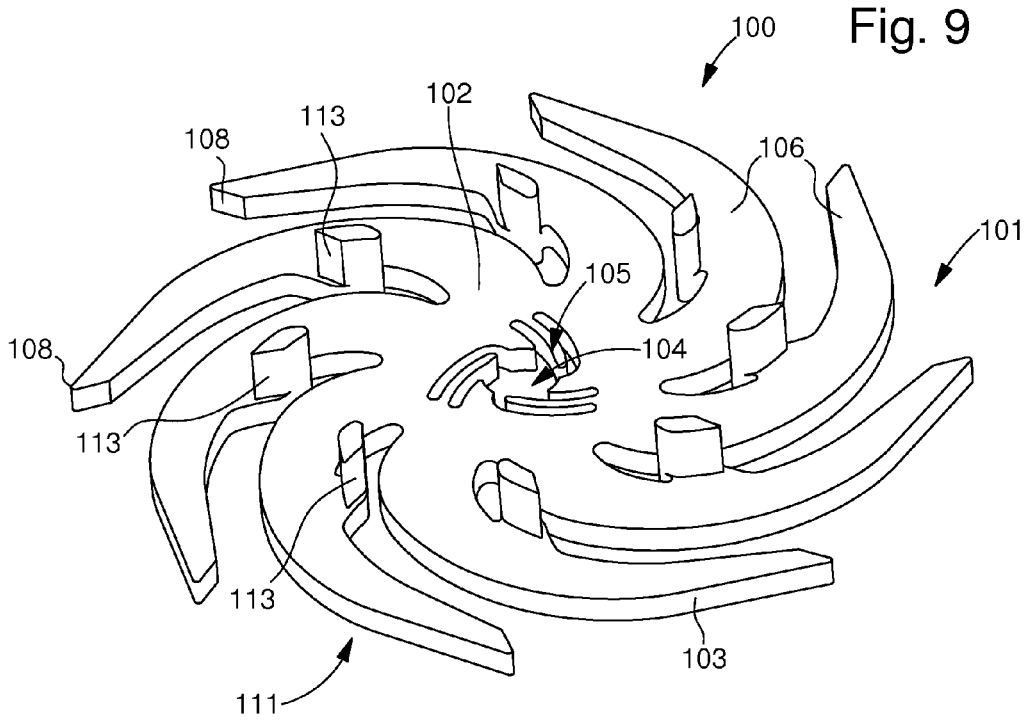
FIG. 9 is a perspective diagram of a coaxial escape wheel set according to a first variant of the invention.
Figure 10:
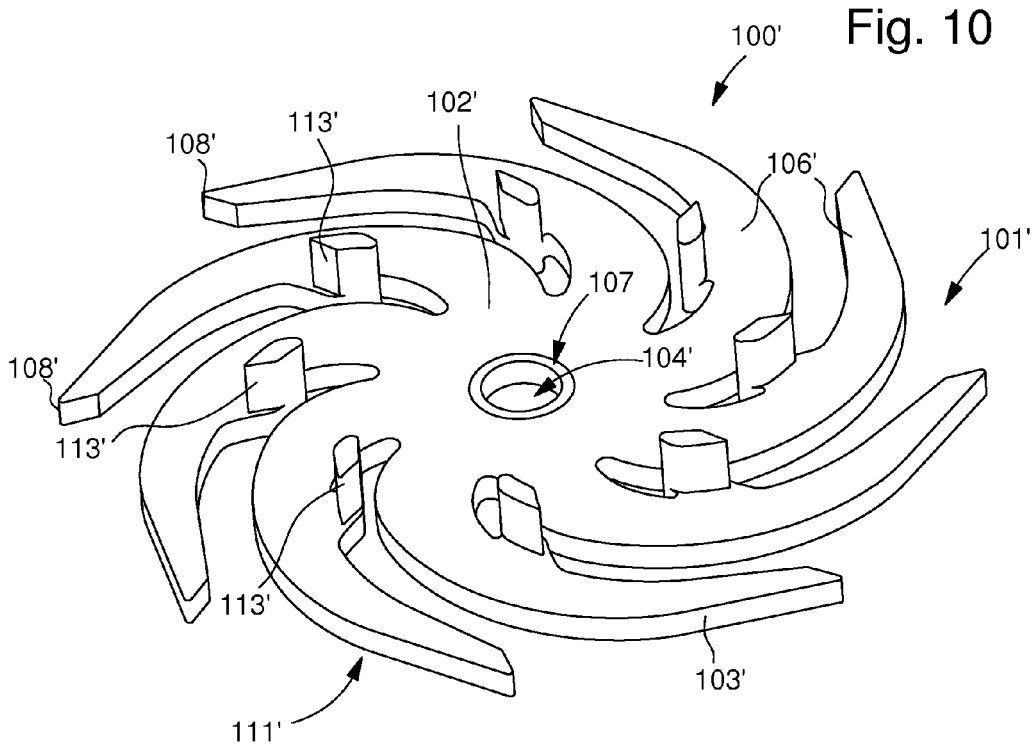
FIG. 10 is a perspective diagram of a coaxial escape wheel set according to a second variant of the invention.

FIGS. 9 and 10 illustrate two example embodiments according to the invention of single piece coaxial escape wheel sets 100, 100'. These wheel sets 100, 100' each include two distinct patterns over one level.

Figure 11:
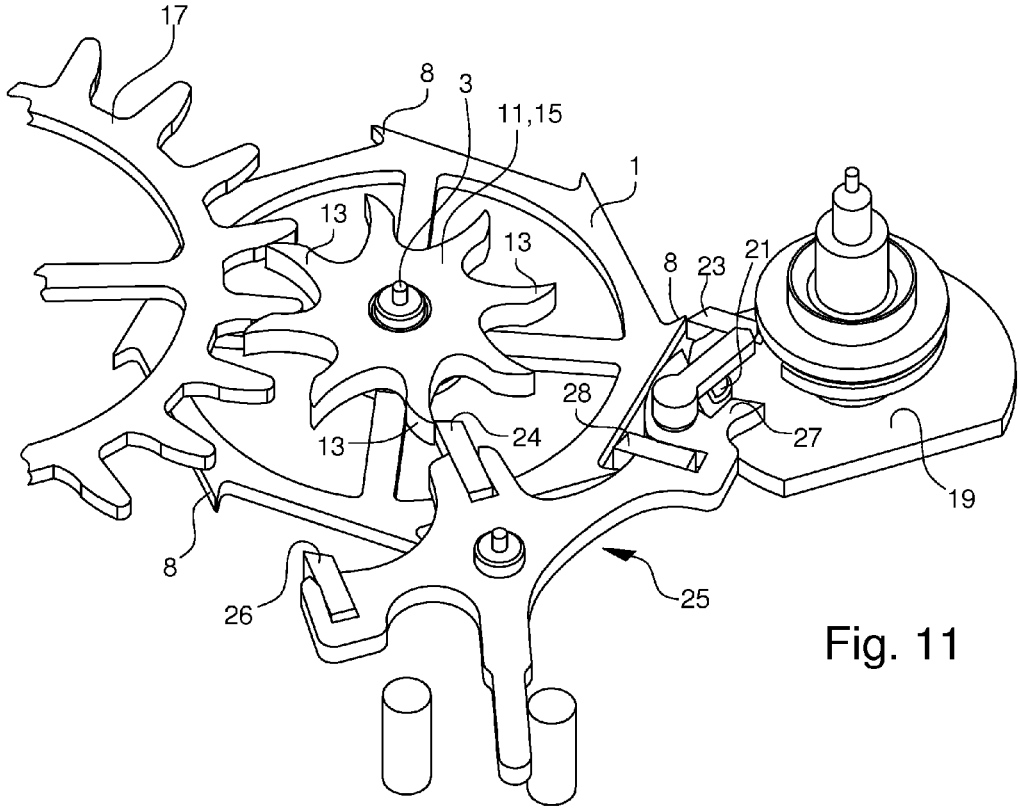
FIG. 11 is a perspective diagram of a coaxial escape system.

According to the first embodiment, shown in FIG. 9, the first pattern forms a toothed wheel 101 corresponding to the first escape wheel 1 of FIG. 11. It includes a plate 103 forming a hub 102, the centre of which has an opening 104 and from which arms 106 start. The end of each arm forms a tooth 108 corresponding to a tooth 8 of FIG. 11. A plate 103 with a first toothing at the periphery thereof is thus obtained.

As illustrated in FIG. 9, opening 104 includes elastic securing means 105 intended to cooperate radially with an arbour of the type referenced 3 in FIG. 11, by elastic deformation, to rotatably mount escape wheel 101 and, consequently, escape wheel set 100. This elastic securing means 105 is formed by elongated parts made by hollowing out a portion of hub 102. The elongated parts enable the arbour to be gripped, i.e. wheel set 100 thereof to be secured, without subjecting the rest of plate 103 to any stress.

Of course, other elastic means may be envisaged. Such elastic means may, for example, take the form of that disclosed in FIGS. 10A to 10E of EP Patent No. 1 655 642, or that disclosed in FIGS. 2 to 5 of WO Patent No. 2007/099068, both documents being incorporated herein by reference.

Thus, advantageously according to the invention, rather than adding a second escape wheel 11 as in FIG. 11, since wheel set 100 is in a single piece, the second pattern 111, which projects from the first 101, is formed solely by a second toothing comprising teeth 113 corresponding to the teeth 13 of FIG. 11.

Preferably, according to the invention, the teeth 113 are independent of each other and integral with arms 106. In the particular example of FIG. 9, it is noted that each tooth 113 is integral with a distinct arm 106. It is therefore clear that the second toothing includes as many teeth 113 as plate 103 has arms 106. However, this feature is not essential and there could very well be several teeth 113 on a single arm 106.

According to the second embodiment, seen in FIG. 10, the first pattern forms a toothed wheel 101' corresponding to the first escape wheel 1 of FIG. 11. It includes a plate 103' forming a hub 102' the centre of which has an opening 104' and from which arms 106' start, each end of said arms forming a tooth 108' corresponding to a tooth 8 of FIG. 11. A plate 103' including a first toothing at the periphery thereof is thus obtained.

As illustrated in FIG. 10, opening 104' includes plastic securing means 107 intended to cooperate radially with an arbour of the type referenced 3 in FIG. 11, for rotatably mounting escape wheel 101' and, consequently, escape wheel 100'. This plastic securing means 107 is formed by a washer made of metallic material allowing wheel set 100' to be driven against said arbour via plastic deformation without subjecting plate 103' to stress. Of course, other plastic securing means may be envisaged.

Thus, advantageously according to the invention, rather than adding a second escape wheel 11 as in FIG. 11, since wheel set 100' is in a single piece, the second pattern 111', which projects from the first 101', is formed solely by a second toothing comprising teeth 113' corresponding to the teeth 13 of FIG. 11.

Preferably according to the invention, teeth 113' are independent of each other and integral with arms 106'. In the particular example of FIG. 10, it is noted that each tooth 113' is integral with a distinct arm 106'. It is therefore clear that the second toothing includes as many teeth 113' as plate 103' has arms 106'. However, this feature is not essential and there could very well be several teeth 113' on a single arm 106'.

These two embodiments of FIGS. 9 and 10 may be formed using many different materials. However, an electroformable material, on the one hand, or a micro-machinable material, on the other hand, are preferred. Indeed, to date, reactive ion etching and LIGA type electroforming are the only processes capable of making parts with the precision necessary (on the order of a few microns) for coaxial wheel set 100, 100' to operate properly. However, any other process capable of respecting the same fabrication tolerances is applicable.

An electroformable material may be formed with gold and/or copper and/or silver and/or indium and/or platinum and/or palladium and/or nickel, although this is not an exhaustive list of compounds. Indeed, other compounds such as phosphorus may be added in smaller quantities. A micro-machinable material may be formed of silicon carbide, crystallised silicon, crystallised alumina or crystallised silica, although this list of compounds in not exhaustive.

The two types of manufacture will be presented respectively in FIGS. 1 to 4 and 5 to 8. FIGS. 1 to 4 show the main successive steps of micro-machining for improved comprehension. Preferably, the method includes a first step consisting in taking a substrate 31 including a top layer 33 and a bottom layer 35 made of micro-machinable materials and secured to each other by an intermediate layer 34. This type of substrate 31 is also known by the abbreviation S.O.I. (Silicon on Insulator).

In a second step, at least one pattern 36 is etched in the top layer 33 until intermediate layer 34 is revealed so as to form at least a first toothing (teeth 108, 108') of escape wheel set 100, 100' at the periphery of a plate 103, 103'. This second step thus allows one or several first pattern(s) 101, 101' of wheel set 100, 100' to be made in top layer 33.

Figure 1:
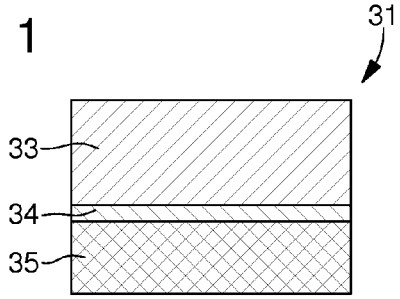
FIGS. 1 to 4 are diagrams of successive steps of the method of manufacturing an escape wheel set according to a first embodiment of the invention.
Figure 2:
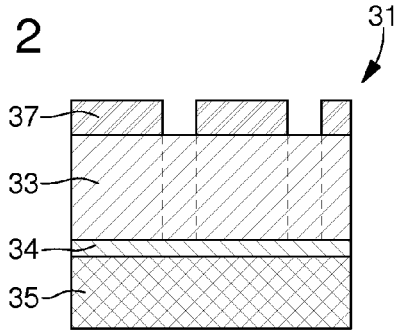
Figure 3:
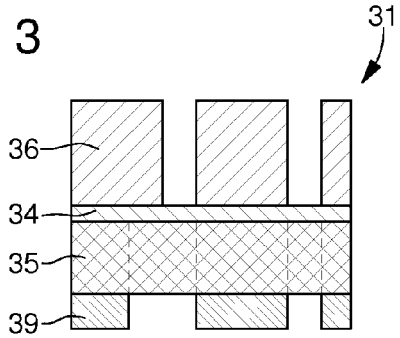

As illustrated in FIG. 2, a mask 37 is formed, for example by photolithography, to protect the part of top layer 33 which is to be kept and then, as illustrated in dotted lines, the top part of substrate 31 is subjected to D.R.I.E. (Deep Reactive Ion Etching). As illustrated in FIG. 3, the first pattern 36, which includes a first level 101, 101' of at least one escape wheel set 100, 100', is obtained.

In a third step, at least one second pattern 38 is etched in bottom layer 33 until the intermediate layer 34 is revealed, so as to form at least a second toothing (teeth 113, 113') in a single piece with the plate 103, 103' of the first toothing (teeth 108, 108') of the escape wheel 100, 100'. This third step thus enables one or several second pattern(s) 111, 111' of wheel set 100, 100' to be formed in bottom layer 35.

Figure 4:
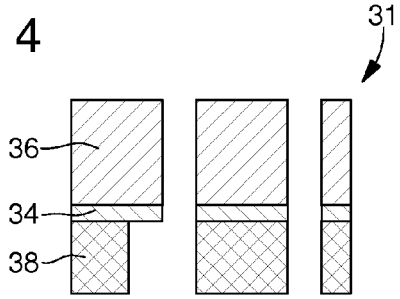

As illustrated in FIG. 3, a mask 39 is formed, for example by photolithography, to protect the part of bottom layer 35 that is to be kept and then, as illustrated in dotted lines, the bottom part of substrate 31 is subjected to D.R.I.E. As FIG. 4 illustrates, the second pattern 38 is obtained, including at least one second level 111, 111' in a single piece with one of the first levels 101, 101' formed in the preceding steps.

It remains only to release each two-level wheel set 100, 100' thereby formed from substrate 31 and, possibly, the exposed parts of intermediate layer 34, so as to mount escape wheel 100, 100' in the final escape system. Preferably, when escape wheel set 100, 100' is formed from a silicon base, an additional oxidation step is performed so as to form at least one silicon dioxide part on the external surface thereof in order to increase the mechanical resistance of the wheel set.

FIGS. 5 to 8 show successive main electroforming steps for improved comprehension. Preferably the method includes a first step consisting in taking a substrate 41 that includes an electrically conductive top layer. This layer may be obtained by depositing an electrically conductive material on an insulating material or by the fact that the substrate is formed of an electrically conductive material.

The main electroforming steps consist in forming a mould and then filling the mould with the material, for example, by galvanoplasty. This type of electroforming is known by the abbreviation L.I.G.A. from the German term "röntgen-LIthographie, Galvanoformung & Abformung". There are several types of L.I.G.A. processes depending upon whether the mould with several levels is formed between each galvanoplasty process or formed entirely and then only subsequently filled. For the explanation below, the technique presented consists in forming each level, i.e. forming one level of the mould and filling it before passing to the next level. Of course, any type of electroforming process capable of forming a single piece wheel set with at least two distinct levels may be envisaged, whether or not it is of the L.I.G.A. type.

Figure 5:
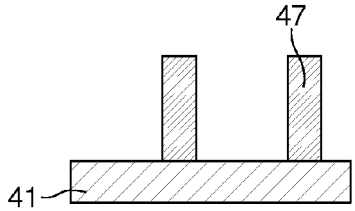
FIGS. 5 to 8 are diagrams of successive steps of a method of manufacturing an escape wheel set according to a second embodiment of the invention.
Figure 6:
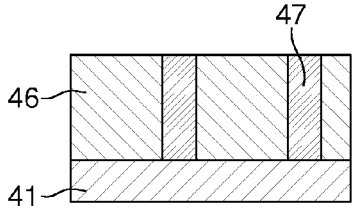

As illustrated in FIGS. 5 and 6, in a first phase, the first level 47 of the mould is formed using, for example, photolithography of a resin as illustrated in FIG. 5. At least one cavity is formed in a shape matching the first pattern 101, 101', i.e. at least a first toothing (teeth 108, 108') of the escape wheel set 100, 100' at the periphery of plate 103, 103'. The first level is then filled via electrodeposition of a metallic material 46.

Figure 7:
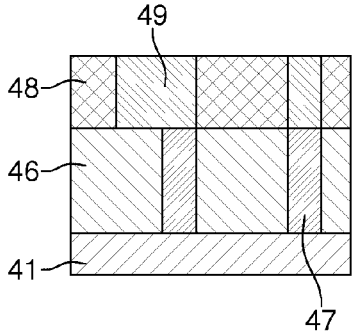

As illustrated in FIG. 7, in a similar way to the first phase, the second level 49 is formed in a second phase by using, for example, photolithography of a resin. At least one recess is formed in a shape matching the first pattern 111, 111', i.e. at least a second toothing (teeth 113, 113') of the escape wheel set 100, 100' and communicating with said at least one cavity of the first level 47. The second level 49 is then filled by electrodeposition of a metallic material 48.

Figure 8:
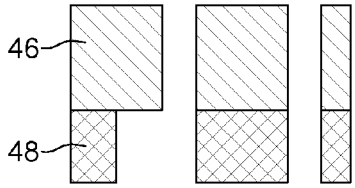

It remains only to release the two-level wheel set 100, 100' thereby formed from substrate 41 and resins 47, 49, as illustrated in FIG. 8, so as to mount escape wheel 100, 100' in the final escape system. In the example of an escape wheel set 100, 100' obtained by electroforming, it is clear that it is no longer necessary to form elastic 105 or plastic 107 securing means because the metallic material can be directly driven onto the arbour through opening 104, 104' thereof.

Of course, this invention is not limited to the illustrated example but is capable of various variants and alterations that will appear to those skilled in the art. In particular, by way of alternative, the toothed wheels 101, 101' could also include a felloe like the one referenced 9 in FIG. 11, without departing from the scope of the present invention.

Moreover, although the example of a coaxial escape wheel is given above, it is very clear that a wheel-pinion type wheel set of a gear train or even a normal escape wheel will have the same advantages. The first toothing 108, 108' would be that of the wheel and the second toothing 113, 113' that of the pinion or vice versa.

Finally, it must be understood that at least two levels are achieved in a single piece. Thus, it is perfectly possible to envisage least one additional level being formed underneath the plate, i.e. the opposite face to that carrying the second toothing 113, 113', and/or above the latter.

What is claimed is:

1. A single piece coaxial escape wheel set including a first toothing formed at the periphery of a plate, wherein the first toothing is arranged to cooperate with a pin and at least a first series of pallet-stones, and a second toothing arranged to cooperate with a second series of pallet-stones, wherein the second toothing is formed in a single piece with the plate of the first toothing so as to reduce any problems of alignment of one in relation to the other and to decrease the overall mass of the escape wheel set.

2. The wheel set according to claim 1, wherein each tooth of the second toothing is independent of the others and projects relative to the plate of the first toothing.

3. The wheel set according to claim 2, wherein the plate is formed of a hub connected to the first toothing via at least one arm.

4. The wheel set according to claim 3, wherein each tooth of the second toothing is integral with said at least one arm of the plate.

5. The wheel set according to claim 4, wherein the second toothing includes as many teeth as the plate has arms.

6. The wheel set according claim 1, wherein the plate includes an opening intended to cooperate with an arbour for rotatably mounting said coaxial escape wheel set.

7. The wheel set according to claim 6, wherein the opening includes securing means that deform elastically to grip the arbour without exerting any destructive stress on the plate.

8. The wheel set according to claim 6, wherein the opening includes securing means that deform plastically to grip the arbour without exerting any destructive stress on the plate.

9. The wheel set according to claim 1, wherein it is made of metal or a metal alloy.

10. The wheel set according to claim 1, wherein it is formed in a silicon-based material.

11. A coaxial escape system for a timepiece, including a lever for cooperating with a single piece coaxial escape wheel set according to claim 1, wherein the first toothing of the wheel set is arranged to cooperate with a pin integral with a balance and intended to cooperate with a first series of pallet-stones of the lever, the second toothing is intended to cooperate with a second series of pallet-stones of the lever and arranged to form the escape pinion.

* * * * *